US008710456B2

(12) United States Patent
Klochkov et al.

(10) Patent No.: US 8,710,456 B2
(45) Date of Patent: Apr. 29, 2014

(54) LINEAR JET IONIZER

(71) Applicants: Aleksey Klochkov, San Francisco, CA (US); Peter Gefter, South San Francisco, CA (US); Steven Bernard Heymann, Los Gatos, CA (US); Leslie W. Partridge, San Jose, CA (US); Greenberry Bedford Brown, Pleasanton, CA (US); Matthew T. Antonelli, Oakland, CA (US)

(72) Inventors: Aleksey Klochkov, San Francisco, CA (US); Peter Gefter, South San Francisco, CA (US); Steven Bernard Heymann, Los Gatos, CA (US); Leslie W. Partridge, San Jose, CA (US); Greenberry Bedford Brown, Pleasanton, CA (US); Matthew T. Antonelli, Oakland, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/947,456

(22) Filed: Jul. 22, 2013

(65) Prior Publication Data

US 2013/0307405 A1 Nov. 21, 2013

Related U.S. Application Data

(63) Continuation of application No. 13/438,538, filed on Apr. 3, 2012, now Pat. No. 8,492,733.

(51) Int. Cl.
*H01J 27/00* (2006.01)

(52) U.S. Cl.
USPC ..... 250/423 R; 250/424; 250/324; 96/52; 96/54; 96/60; 96/63; 96/95; 96/96; 96/97; 95/58; 95/78; 361/213; 361/225; 361/226; 361/227; 361/228; 361/229; 361/230; 361/231; 361/232; 361/233; 361/234; 361/235

(58) Field of Classification Search
USPC ..... 250/423 R, 424, 324; 96/52, 54, 60, 62, 96/63, 95–97; 95/58, 78; 361/213, 361/225–235
See application file for complete search history.

(56) References Cited

U.S. PATENT DOCUMENTS 4,442,356 A 4/1984 Ludwick et al. ..... 250/324
7,057,130 B2 * 6/2006 Gefter et al. ..... 219/121.36

(Continued)

FOREIGN PATENT DOCUMENTS

WO WO 03/100932 12/2003

OTHER PUBLICATIONS

PCT Application PCT/US2012/033278, Notification of . . . , International Search Report and Written Opinion of the International Searching Authority, mailed Sep. 14, 2012; 13 pages total.

(Continued)

*Primary Examiner* — Jack Berman
*Assistant Examiner* — Meenakshi Sahu
(74) *Attorney, Agent, or Firm* — The Patent Source

(57) ABSTRACT

A multi-sectional linear ionizing bar with at least four elements is disclosed. First, disclosed bars may include at least one ionization cell with at least one axis-defining linear ion emitter for establishing an ion cloud along the length thereof. Second, disclosed bars may include at least one reference electrode. Third, disclosed bars may include a manifold for receiving gas or air from a source and for delivering same past the linear emitter(s) such that substantially none of the gas/air flows into the ion cloud. Fourth, disclosed bars may include means for receiving the ionizing voltage and for delivering same to the linear emitter(s) to thereby establish the ion cloud. In this way, disclosed ionizing bars may transport ions from the plasma region toward a charge neutralization target without inducing substantial vibration of the linear emitter and without substantial contaminants from the gas/air flow reaching the linear emitter.

25 Claims, 15 Drawing Sheets

(56) References Cited

U.S. PATENT DOCUMENTS

| | | | | |
|---|---|---|---|---|
| 7,679,026 | B1 * | 3/2010 | Gefter et al. | 219/121.52 |
| 7,821,762 | B2 | 10/2010 | Yasuoka et al. | 361/212 |
| 7,822,355 | B2 | 10/2010 | Schlitz | 399/100 |
| 8,038,775 | B2 * | 10/2011 | Gefter | 96/63 |
| 8,174,814 | B2 | 5/2012 | Yasuoka et al. | 361/230 |
| 8,492,733 | B1 * | 7/2013 | Klochkov et al. | 250/423 R |
| 2008/0199208 | A1 * | 8/2008 | Schlitz | 399/100 |
| 2012/0224293 | A1 * | 9/2012 | Partridge et al. | 361/230 |

OTHER PUBLICATIONS

Webpages from LIROS website, ten sheets, date unknown, available online at http://www.liroselectronic.com.

* cited by examiner

LINEAR JET IONIZER

CROSS REFERENCE TO RELATED CASES

This application claims the benefit under 35 U.S.C. 119(e) of the following co-pending U.S. Provisional Patent Application Ser. No. 61/584,173 filed Jan. 6, 2012 and entitled "MULTI-SECTIONAL LINEAR IONIZING BAR—LINEAR IONIZER"; and U.S. Application Ser. No. 61/595,667 filed Feb. 6, 2012 entitled "MULTI-SECTIONAL LINEAR IONIZING BAR AND IONIZATION CELL"; which applications are hereby incorporated by reference in their entirety.

BACKGROUND OF THE INVENTION

1. Field of the Invention

The present invention is directed to multi-sectional linear ionizing bars and other corona discharge based ionization systems, processes and apparatus for charge neutralization. The invention is particularly useful in (but not limited to) Flat Panel Display (FPD) industrial applications. Accordingly, the general objects of the invention are to provide novel systems, methods and apparatus of such character.

2. Description of the Related Art

Conventional static neutralization systems for the FPD industry are usually composed of: (1) a bar type ionization cell having a group of pointed emitters and non-ionizing reference electrode(s); (2) a clean air (gas) supply system having a group of jet type nozzles surrounding each ion emitter and connected to an air channel; and (3) a control system with an AC or pulsed AC high voltage power supply connected to the ionization cell.

Charge neutralization in the FPD industry typically entails neutralization of large charged objects at relatively close distances and at rapid throughput rates. For example, the front and back of glass panels having a length and a width exceeding 3000 mm may need to be charge-neutralized wherein the distance between an ionizing bar(s) and the display panels usually ranges from 50-100 mm up to 1000 mm or more, and wherein the display panels are transported at high speeds using robotics systems.

The use of traditional charge-neutralization ionizing bars of the type described above presents several deficiencies/drawbacks/limitations in trying to satisfy the above-described demanding requirements for charge neutralization of the FPD industry. These deficiencies may include:

The high cost of traditional ionization cells incorporating a multiplicity of emitter points due to the need for (1) several individual connectors between a high voltage power supply and the emitter(s), and (2) a relatively complicated air/gas delivery system;

The high cost of operating and maintaining traditional ionization cells, including the cost of (1) cleaning nozzles and emitter points, and (2) high clean dry air (CDA) or nitrogen gas consumption during operation;

Insufficient cleanliness of the ionized gas stream because the higher quality of high resolution flat panel displays requires low or no particle emission (at least no particles larger than 0.1 micron) from the ion emitter(s);

Unacceptably long discharge times for electrostatic charges because display panel throughput rates demand higher charge neutralization efficiency than has been heretofore available; and Unacceptably high voltage swings and balance off-sets because lower voltage swings and balance offset voltages are needed to minimize the effects of induced electric fields on processed panels.

Charge neutralizing bars with linear ionizers (ionizing cells comprising long thin wire(s) as emitter(s)/electrode(s)) have been suggested in (1) U.S. Pat. No. 7,339,778, entitled "Corona Discharge Neutralizing Apparatus"; (2) U.S. Pat. No. 8,048,200, entitled "Clean Corona Gas Ionization For Static Charge Neutralization"; and (3) U.S. Patent Application Publication US 2007/0138149. U.S. Pat. No. 7,339,778, entitled Corona Discharge Static Neutralizing Apparatus, and issued on Mar. 4, 2008 is hereby incorporated by reference in its entirety. U.S. Pat. No. 8,048,200, entitled Clean Corona Gas Ionization For Static Charge Neutralization, and issued on Nov. 1, 2011 is also hereby incorporated by reference in its entirety. Further ionizing bars with wire emitters are currently produced by AB Liros Electronic of Malmö, Sweden and/or Liros Electronic of Hamburg, Germany using the following product names: standard series ionizers and/or SER series ionizing tubes.

Common problems encountered by the use of stretched wire emitter ionizers (linear ionizers) can be due to wire sagging and vibration effects. Thus, a long thin wire emitter requires relatively high tension and intermediate wire supports. In addition, high velocity air streams directly blowing ions off of the linear wire emitters exacerbate the inherent problem of wire vibration and accelerate contamination of the wire emitter (as a result of particles attracted to the wire from entrained ambient air). Both factors make wire emitters prone to breakage and complicate linear ionizer bar maintenance.

SUMMARY OF THE INVENTION

The currently disclosed invention suggests new approaches for linear ionizing bar design that are capable of solving the above-mentioned problems and, thus, are naturally beneficial for FPD industrial (and other) applications.

In one form, the present invention satisfies the above-stated needs and overcomes the above-stated and other deficiencies of the related art by providing a multi-sectional linear ionizing bar having at least one ionization cell with at least one axis-defining linear ion emitter for establishing an ion cloud along the length thereof in response to the application of an ionizing voltage thereto, the ion cloud having an outer peripheral boundary. The bar may also have a means for receiving an ionizing voltage and for delivering the ionizing voltage to the linear ion emitter to thereby establish the ion cloud. A reference electrode may present an electric field within the ion cloud in response to receipt of a non-ionizing voltage being applied to the reference electrode, the electric field inducing ions to leave the ion cloud. Finally, the bar may have a manifold for receiving a flow of gas and for delivering the gas past the linear ion emitter and toward a target object such that at least some of the gas flows tangent to the outer peripheral boundary of the ion cloud but substantially none of the gas flows into the ion cloud.

Methods in accordance with the invention may contemplate directing a bi-polar ionized stream of gas toward a target object using an ionizing bar of the type having an axis-defining linear ionizing emitter and a reference electrode and plural orifices for delivering a flow of gas toward the target object. Inventive methods may include the steps of applying an ionizing voltage to the linear ion emitter to thereby establish a bi-polar ion cloud along the length thereof, the ion cloud having an outer peripheral boundary; of applying a non-ionizing voltage to the reference electrode to thereby present a non-ionizing electric field within the ion cloud, the non-ionizing electric field inducing ions to leave the bi-polar ion cloud; and of delivering the gas through the orifices and past the linear ion emitter and toward the target object such that at least some of the gas flows tangent to the outer peripheral boundary of the ion cloud but substantially none of the gas flows into the plasma region of the ion cloud to thereby direct a bi-polar ionized stream of gas toward the target object.

In a related form, the invention is directed to a selectively removable ionization cell for use in a multi-sectional linear ionizing bar wherein the cell may have an elongated plate having a plurality of openings through which gas may flow, the openings being disposed in spaced relation to one another along the length of the elongated plate. The cell may also have at least one axis-defining linear ion emitter for establishing an ion cloud along the length thereof in response to the application of an ionizing voltage thereto, the ion cloud having an outer peripheral boundary and the emitter being suspended in spaced relation to the plate such that the emitter axis is at least substantially parallel to the elongated direction of the plate. Also the inventive cell may have at least one spring tensioning contact for stretching the linear ion emitter, for receiving an ionizing voltage and for delivering the ionizing voltage to the linear ion emitter to thereby establish the ion cloud.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
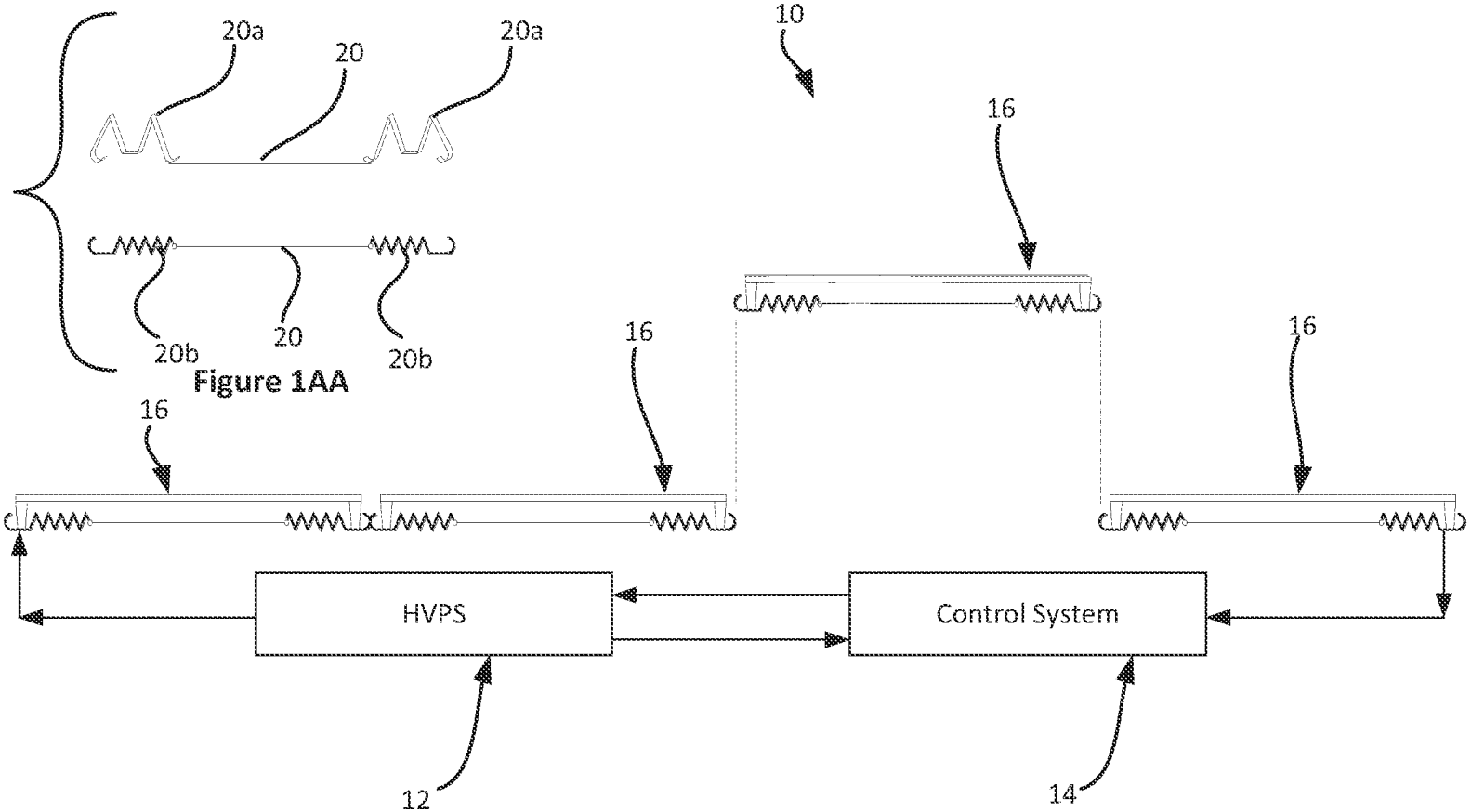
FIGS. 1A and 1AA are schematic representations of an inventive multi-sectional linear ionizing bar (using either coil or flat spring options) with an associated high-voltage power supply and an associated control system.

With joint reference to all of the Figures, the inventive multi-sectional linear ionizing bar 10 preferably comprises at least three primary elements: at least one ionization cell 16 with at least one axis-defining linear ion emitter 20 for establishing an ion plasma region (or ion cloud) 22 along the length thereof, a manifold 24 for receiving gas from a source and for delivering same past linear ion emitter(s) 20 such that substantially none of the gas flows into the plasma region, and means for receiving (20*a* and/or 20*b*) ionizing voltage from a suitable power supply 12 (optionally, with a suitable control system 14) and delivering same to linear ion emitter(s) 20 to thereby establish an ion plasma region 22 having an outer peripheral boundry.

With primary reference to FIGS. 1A and 1AA, one may see preferred schematic representations of an inventive multi-sectional linear ionizing bar 10 (using either coil 20*b* or flat 20*a* spring options) with associated high-voltage power supply (HVPS) 12 and associated control system 14. In the example shown, ionizer 10 includes four detachable and disposable ionizer modules 16. Electrically, all emitter electrodes 20 may be connected in series by spring tensioning contacts 20*a*, 20*b*. In this way, emitter wires 20 and the tensioning contact springs 20*a*, 20*b* function as one high voltage bus. One terminal 20*a*, 20*b* of a first emitter module 16 (which is located close to the output of the HVPS) is preferably connected to high voltage power supply 12 and a second terminal 20*a*, 20*b* (at opposite side of ionizing bar 10) may be connected to control system 14.

Control system 14 may monitor the electrical integrity of all linear emitter wires 20 and the ionization cell contacts 20*a*, 20*b*. To establish the desired (at least generally cylindrical or ellipsoid) ion cloud (plasma region) 22, HVPS 12 and control system 14 may be configured and operated as described in U.S. Pat. No. 7,057,130, entitled Ion Generation Method And Apparatus, and issued on Jun. 6, 2006, which patent is hereby incorporated by reference in its entirety. This power and communication connectivity is preferably provided by multi-conductor connectors 42 disposed on the side of an enclosure housing 21 (see, for example, FIG. 3B). This permits control system 14 to control bar 10 in response to the status of various other machinery. For example, bar 10 may be shut down if production has ceased for some reason. Status lights 44 may also be provided to indicate various conditions (such as alarms) to an operator.

FIG. 1AA shows the preferred optional configurations for coil or flat springs 20*b* and 2*a*. Coiled spring 20*b* may have one terminal end thereof electrically connected to wire emitter 20 and a second terminal end electrically connected to an electrical contact 35 that extends to the exterior of module 16 for electrical contact with one of HVPS 12, control system 14 or another module 16 as described above and shown throughout the Figures. Flat spring 20*a* may be generally W-shaped and may provide both of the tensioning and contact functions in one integral piece, thereby potentially reducing electrical connections, thereby reducing maintenance and increasing reliability.

Figure 2A:
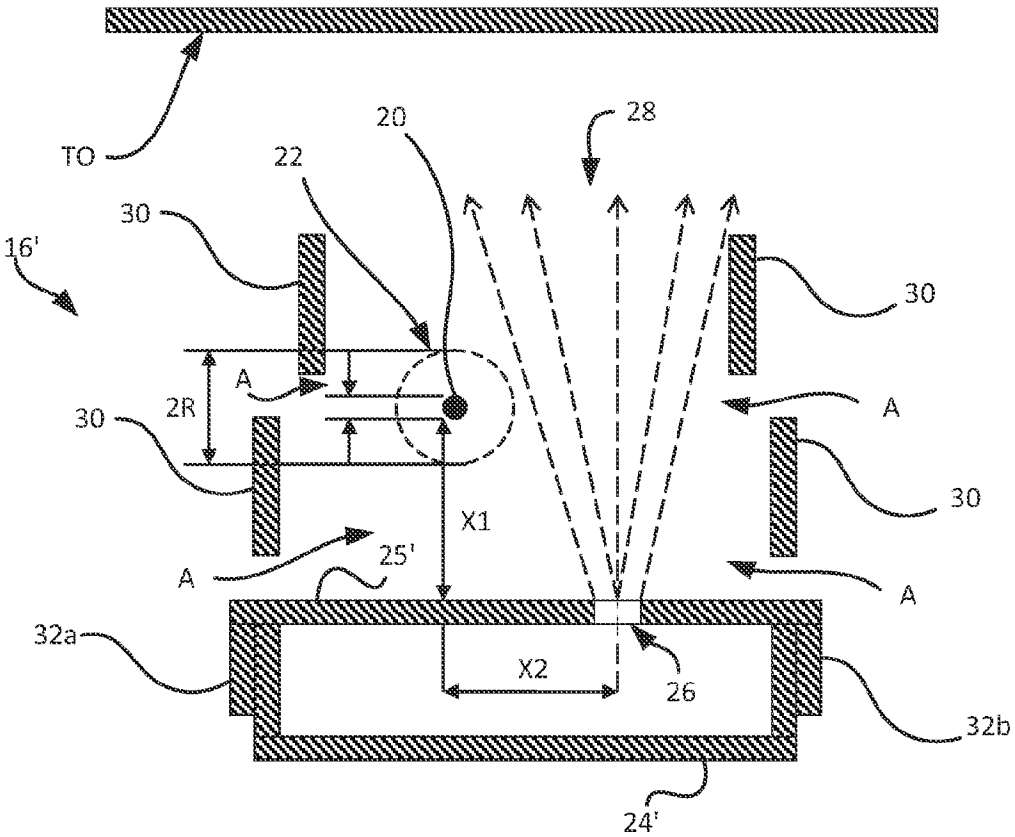
FIG. 2A schematically illustrates (in cross-sectional view) one preferred relationship between air/gas flow and the position of an ion cloud within a linear ionizing bar employing an air/gas flow orifice arrangement in accordance with the present invention.
Figure 2B:
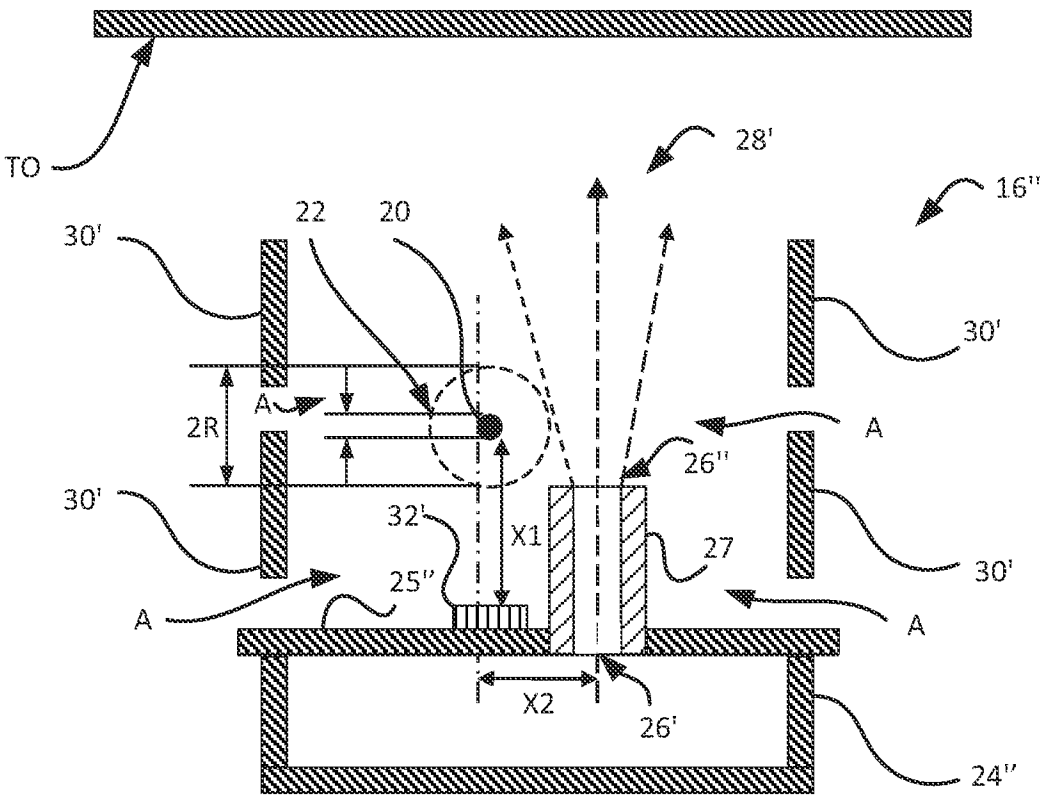
FIG. 2B schematically illustrates (in cross-sectional view) another preferred relationship between air/gas flow and the position of an ion cloud within a linear ionizing bar employing a nozzle proximate to a linear emitter in accordance with the present invention.
Figure 2C:
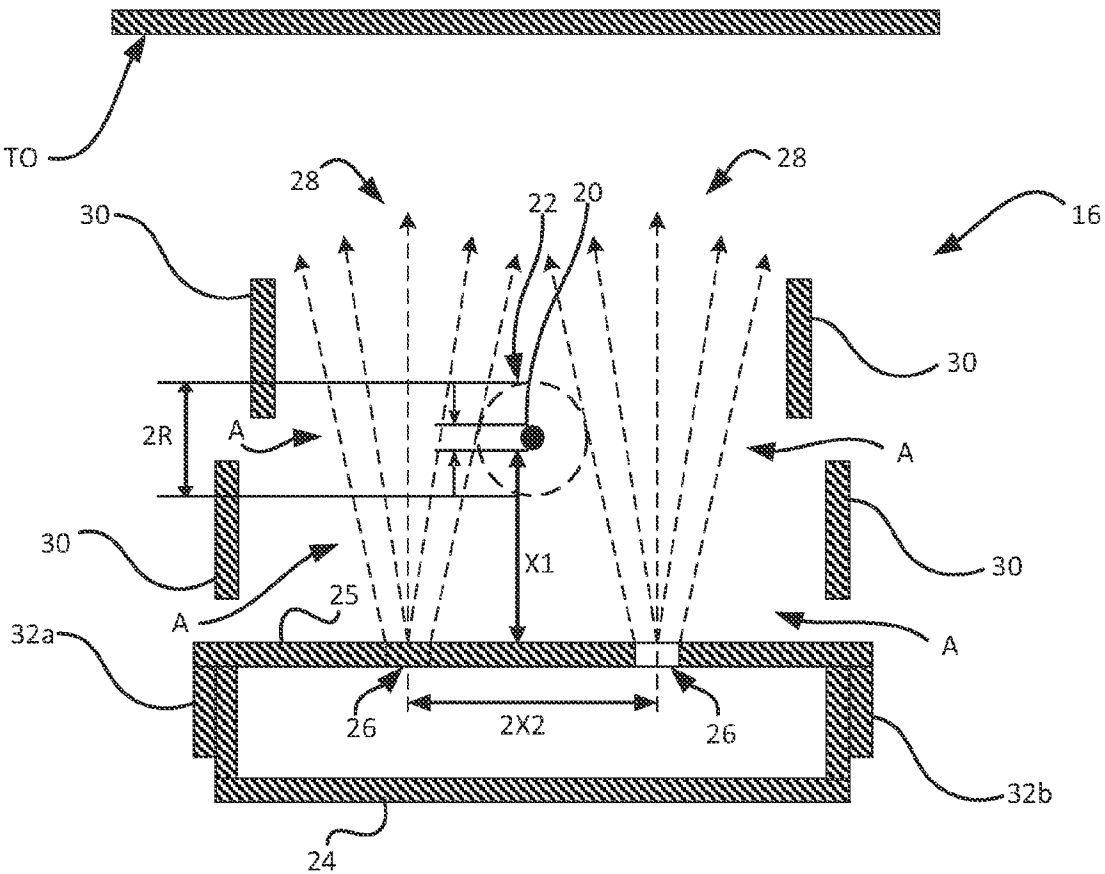
FIG. 2C schematically illustrates (in cross-sectional view) still another preferred relationship between air/gas flow and the position of an ion cloud within a linear ionizing bar employing a plurality of advantageously positioned air/gas flow orifices in accordance with the inventive physical embodiments shown in FIGS. 3A through 4C.

Turning now primarily to FIGS. 2A through 2C but also with continuing reference to all of the Figures, each ionization cell 16 of a bar 10 may comprises at least one linear, for example, wire type corona discharge ion emitter/electrode 20, at least one non-ionizing reference electrode 32*a* and 32*b* or 32' (which may be held at a suitably low electrical potential such as ground—zero volts) and an array (multiplicity/plurality) of gas orifices 26 or 26'/26"/27 positioned between the electrodes 32*a* and 32*b* or in the vicinity of electrode 32' as shown. Each of orifices (gas outlets or nozzles) 26 or 26'/26"/27 may be circular and, if so, may have an aperture diameter ranging between about 0.0098 inches and about 0.016 inches (with about 0.0135 inches being most preferred). Orifices 26 or 26'/26"/27 may be formed by drilling, cut with laser, sand blasted or cut with a water jet. They may be uniformly spaced from one another by a distance ranging between about 25 millimeters and about 75 millimeters (with about 50 millimeters being most preferred) as measured at least substantially parallel to linear ionizer 20 or the axis defined thereby (into the plane of the page as shown in FIGS. 2A through 2C). Also, as shown in the various Figures, every other orifice may, optionally, be located on laterally opposite side of linear ionizer 20. Each orifice output 26 or 26'/26"/27 may create a high speed of air/gas jet and to thereby entrain ambient air A in accordance with the "Coanda" effect. As discussed in detail immediately below, an optimal distance may exist between linear emitter electrode 20 and the air/gas orifice(s) 26 or 26'/26"/27.

FIGS. 2A through 2C conceptually illustrate the relationship between air/gas streams 28 and ions flows in the cross-sectional view of ionization cells 16, 16' and 16". In particular, FIG. 2A schematically illustrates a simplified relationship between air/gas flow 28 from one advantageously positioned orifice 26 and the position of ion cloud 22 within a cell 16'. FIG. 2B schematically illustrates a simplified relationship between air/gas flow 28' from one advantageously positioned orifice/nozzle 26'/26"/27 and the position of ion cloud 22 within a cell 16" in accordance with an alternate embodiment of the present invention. FIG. 2C schematically illustrates a more realistic preferred relationship between air/gas flow 28 from plural advantageously positioned air/gas flow orifices 26 and the position of ion cloud 22 within a cell 16 in accordance with the inventive physical embodiments shown in FIGS. 3A through 4C.

As shown in FIGS. 2A trough 2C, linear electrode 20 (wire) extends perpendicular to the plane of the page and is positioned at distance from surface 25/25'/25" of the manifold 24/24'/24" and away from reference electrode(s) 32'/32*a*/32*b*. The ideal vertical distance X1 (between ionizing 20 and non-ionizing reference electrodes 32'/32*a*/32*b*) is defined by various parameters of high voltage power supply 12 such as voltage amplitude, frequency and ion current. Conventional means may be used to select distance X1 as is known in the art and, especially, in light of the disclosure of U.S. Pat. No. 7,057,130, entitled Ion Generation Method And Apparatus, and issued on Jun. 6, 2006, which patent has been incorporated by reference in its entirety. When high voltage AC is applied to linear electrode(s) 20, corona discharge occurs to thereby yield copious amounts of both polarity ions. As a result, emitter(s) 20 is/are surrounded by dense, high-concentration bipolar ion cloud 22 of positive and negative ions. Cloud 22 is idealized in FIGS. 2A through 2C as a circular dotted line as is generally accurate for the generally cylindrical ion cloud(s) resulting from the application of a high-frequency AC voltage. It will be understood, however, that low-frequency AC voltage would more likely result in the generation of an ion cloud(s) that may be at least generally ellipsoidal.

In the case of FIGS. 2A and 2C, the top surface 25 and 25' of manifold 24, 24', for example, may consist of a flat orifice plate with circular hole(s)/aperture(s) extending there through for each orifice 26. As noted above, the ideal vertical distance X1 (between ionizing 20 and non-ionizing reference electrodes 32'/32*a*/32*b*) is defined by various parameters of high voltage power supply 12 such as voltage amplitude, frequency and ion current. The center of each orifice 26 preferably lies at a horizontal distance X2 from the center 20 of ion cloud (or wire electrode) 22. The ideal value of X2 can be calculated based on the geometric conditions that place the outer contour of air/gas stream 28 substantially tangent to ion cloud 22 in accordance with the following equation:

$$X2=R+X1/\tan(90°-\beta)$$

For example, if R=the radius of the plasma region of the ion cloud=about 1 mm to about 1.5 mm (typical for a high frequency ionizing voltage), if X1=7 mm to 8 mm, and if β=dispersion angle of gas stream (jet) from orifice(s) 26=10 degrees to 15 degrees, then tan 75°=3.73 and X2=3.9 mm.

An alternate preferred embodiment (shown in FIG. 2B) may have an array of small nozzles 26'/26"/27 (tube-like nozzles with circular or elliptical outlet configurations in cross-section) or "Venturi" type nozzles positioned at the top part 25" of manifold 24" and connected to the holes in the orifice plate. The orifice(s)/outlet(s) 26" may be located in close proximity to ion cloud 22. If so, higher air/gas velocity will harvest more ions from ion cloud 22 as well entrain a larger volume of ambient air as compared with the configurations illustrated in FIGS. 2A and 2C. The embodiment of FIG. 2B may have one reference electrode 32' (for example, a metal strip) positioned within the ionizing cell and at least generally parallel to wire emitter 20.

The modified equation for calculating X2 for this embodiment can be:

$$X2=R+(X1-H)/\tan(90°-\beta)$$

wherein H is the height (or length) of the nozzle.

Nozzles 27 may be made of either isolative (insulating) or conductive materials. In latter case, the group of plural nozzles 27 may be electrically connected to one another and may be used plural reference electrodes relative to high voltage power supply 12. Consequently, the corona discharge current flows from ion emitter 20 to conductive nozzles/reference electrodes 27 and the ion current and ion cloud are concentrated in a region of high air/gas velocity. This provides optimal conditions for ion harvesting and transportation to a charged target TO.

Right and left grills (comprising plural spaced louvers/rails 30, 30') on laterally opposite sides of each emitter 20 generally defines the shape/outer-contour of each ionization cell 16. High speed clean dry air (CDA) flowing through orifices 26 or 26'/26"/27 creates a low pressure space surrounding gas stream(s) 28 and entrains (sucks) ions out of ion cloud/plasma region(s) 22 as well as ambient air A through the openings/gaps between the louvers/rails 30 (30').

At an optimal distance (horizontal offset X2) between the centers of ion cloud 22 and orifice 26/26'/26" gas stream 28 and entrained ambient air A efficiently moves ions from ionization cell 16 to the charged target object TO. With this arrangement, ion harvesting (transporting ions from ionization cell(s) 16 to the target object(s)) occurs with substantially none of the gas streams 28 directly touching the wire surface (without gas streams 28 blowing directly onto ion emitter(s) 20). Since wire electrode(s) 20 has/have no direct impact/interaction with gas stream(s) 28, substantially no wire vibration is induced by gas stream(s) 28 and substantially no contaminants in gas stream(s) 28 and/or contaminants inherently present in the entrained ambient air A contact wire electrode(s) 20.

Turning primary focus now to FIGS. 3A through 4C, each cell 16, 16'" includes a long central orifice plate that functions as a gas manifold with a number of channels, orifices or slots 26 permitting gas/air 28 to flow though. At least one manifold channel is connected to a source of high pressure CDA (or another gas) through gas-flow connector 40. At least one line (row) of small orifices (circular or elongated slots) 26 is staggered on both lateral sides of ion emitter (s) 20. Both orifice rows (lines) preferably have equal offset relative linear emitter axis 20. Optionally, gas flows 28 around linear emitter 20 may be arranged, for example, by two rows of narrow slots cut in the orifice plate, the rows being at least generally parallel with the emitter.

Figure 3A:
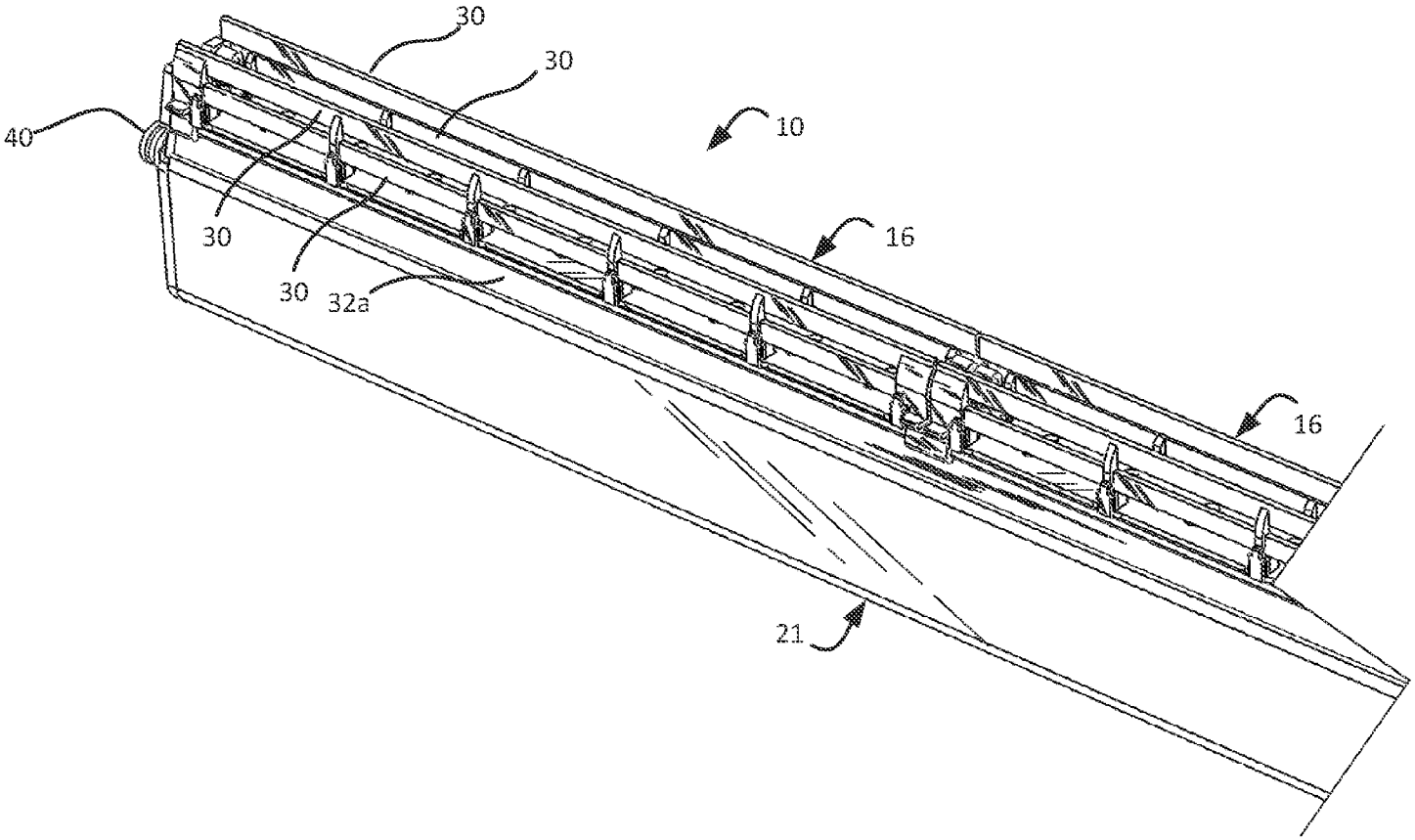
FIGS. 3A-3C show perspective views of a preferred physical embodiment of a flat-spring multi-sectional ionizing bar of the present invention.
Figure 3B:
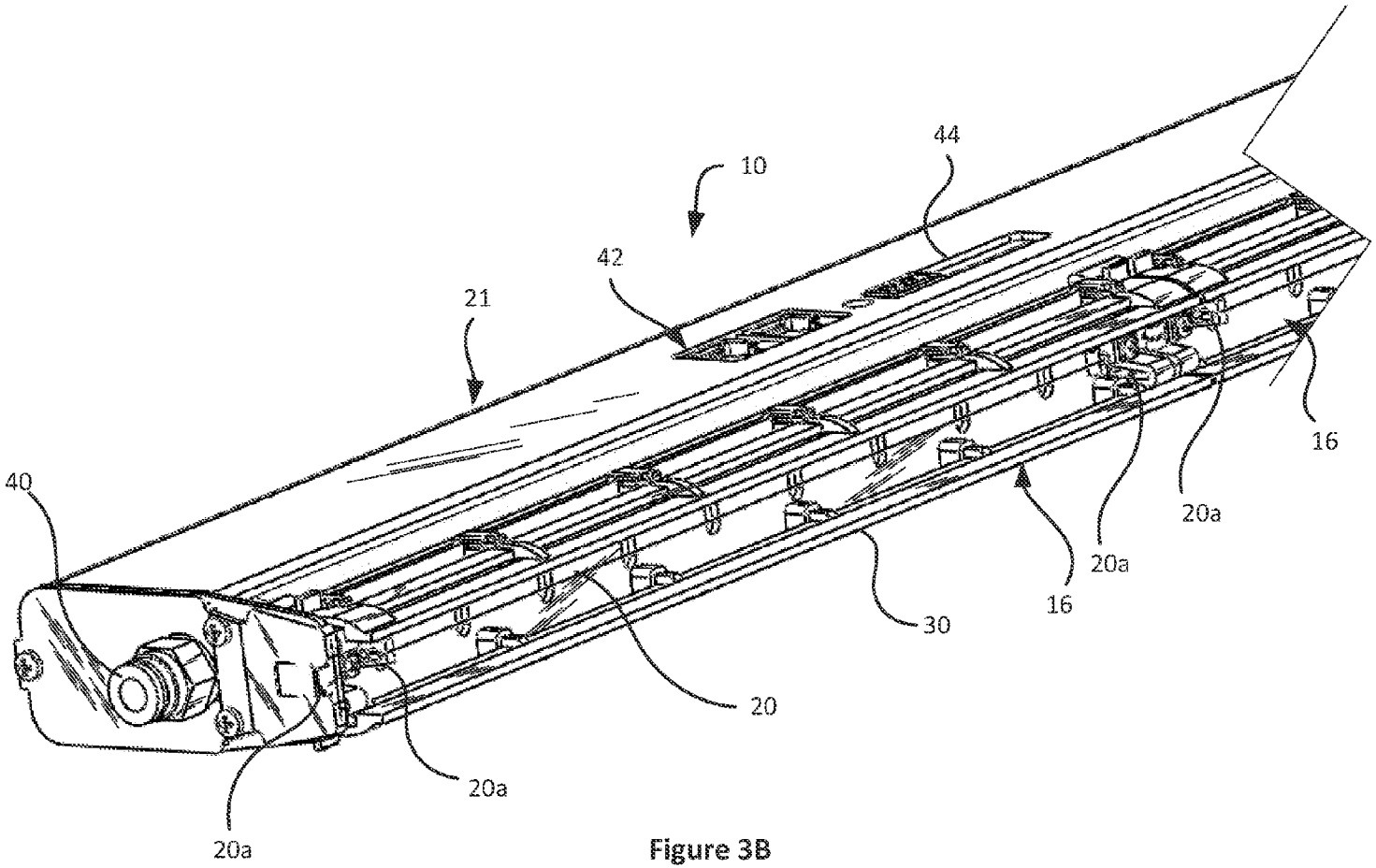
Figure 3C:
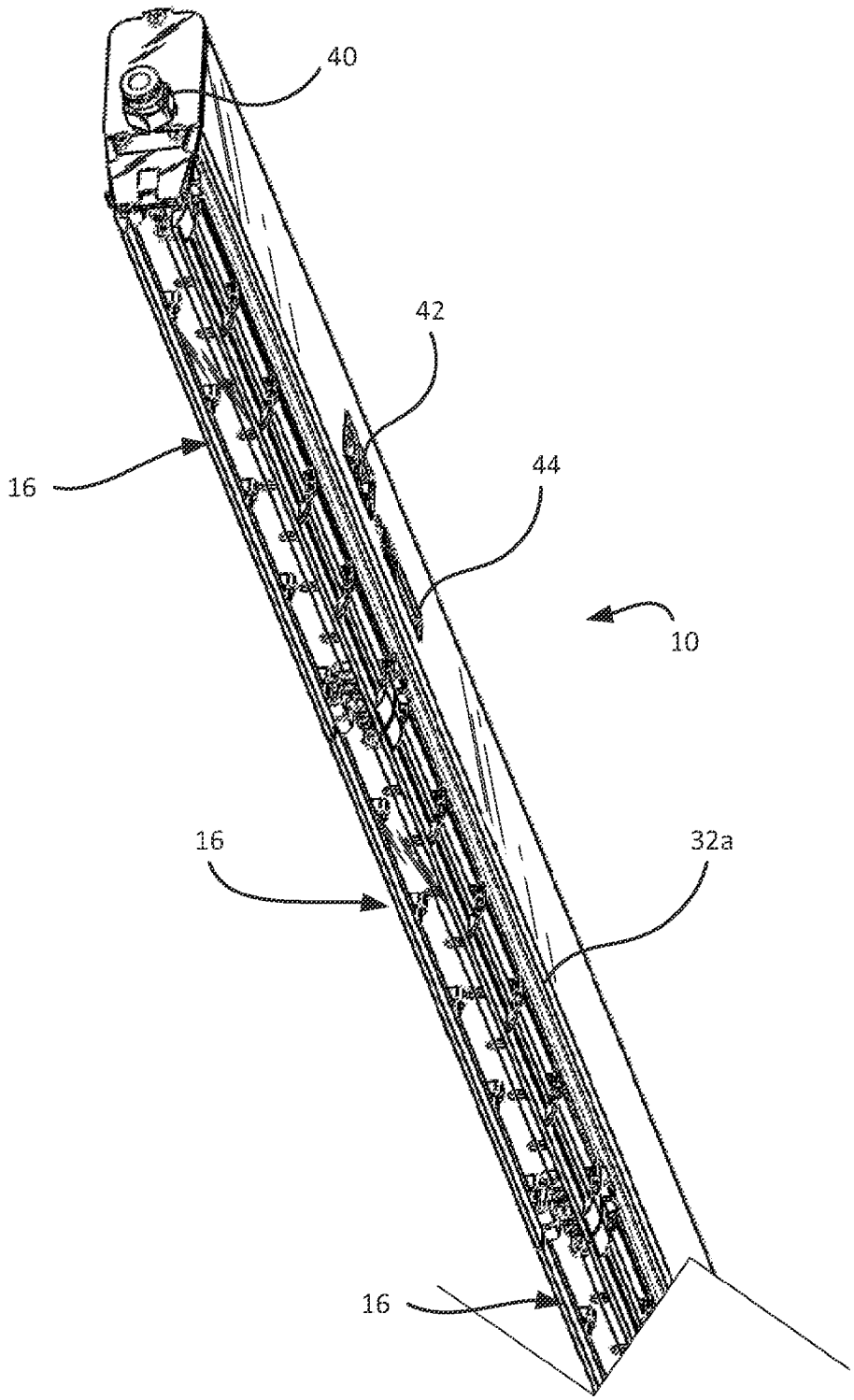
Figure 3D:
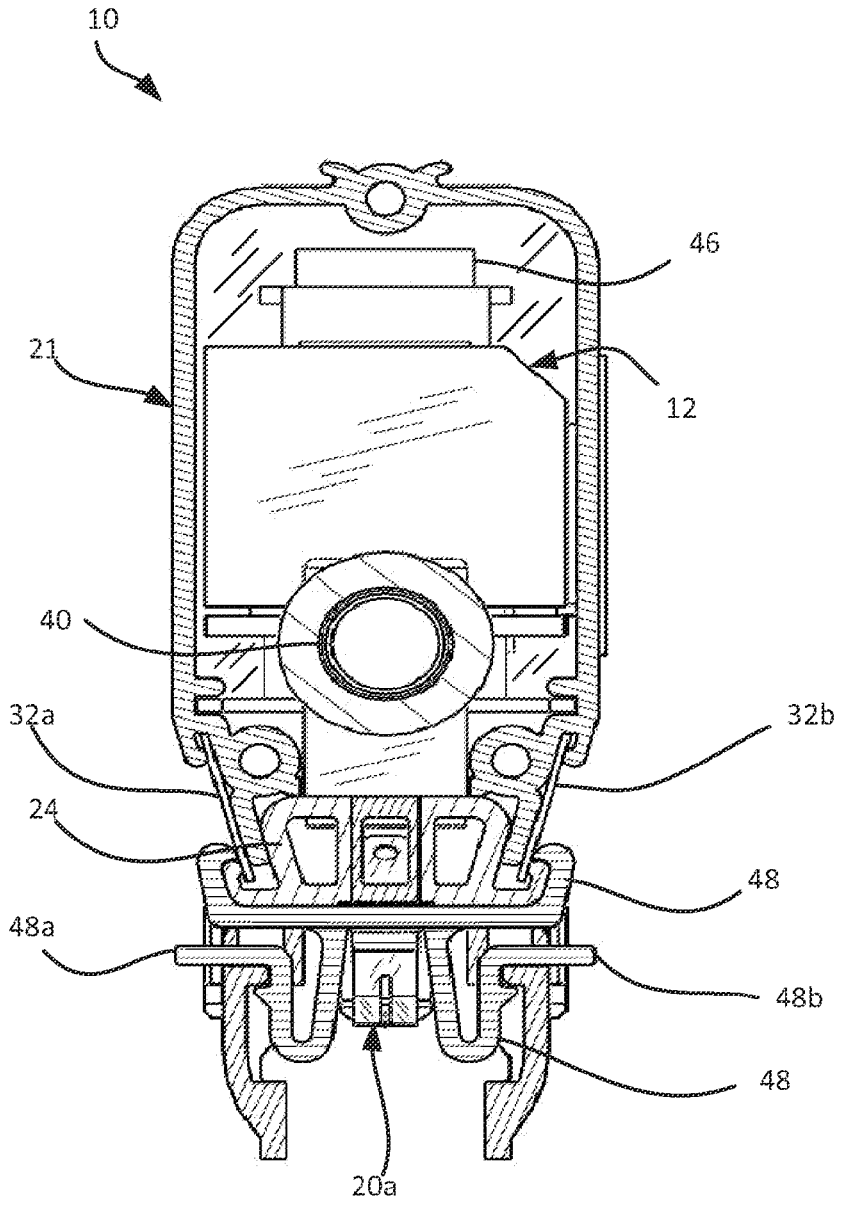
FIG. 3D shows a cross-sectional view of the flat-spring multi-sectional ionizing bar of FIGS. 3A-3C, with the section taken along line 3D-3D of FIG. 3E.
Figure 3E:
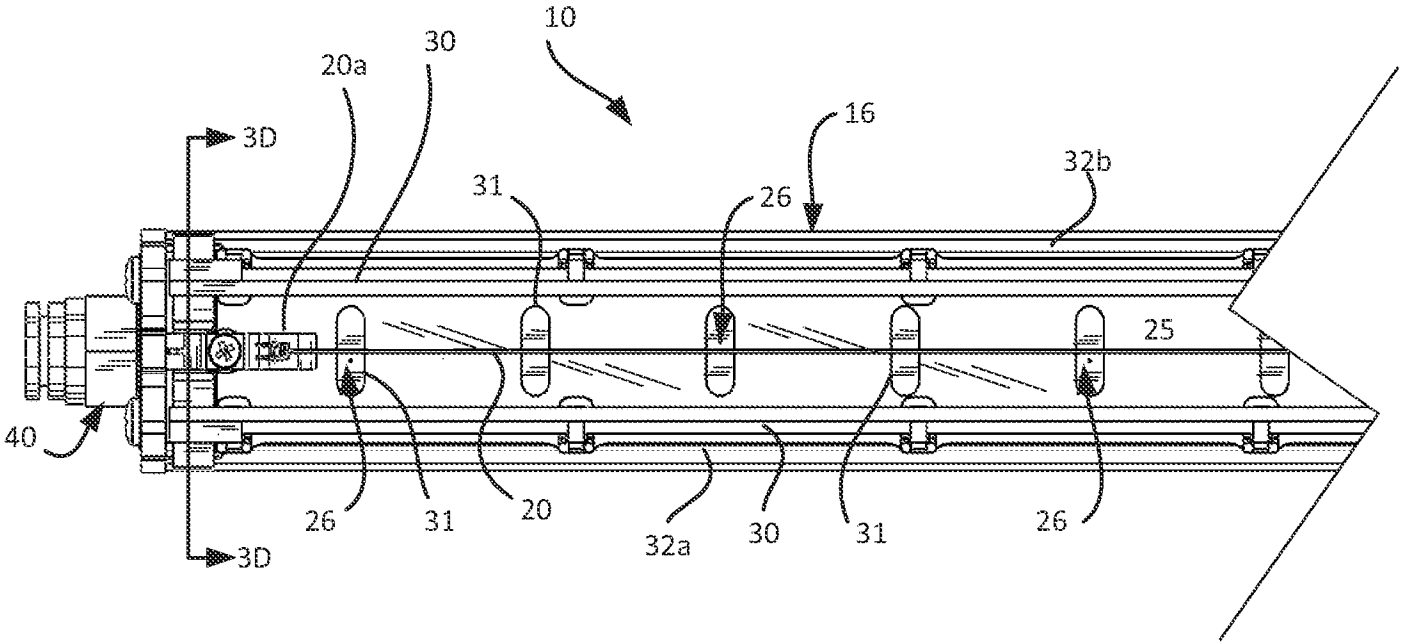
FIG. 3E shows a bottom view of the flat-spring ionizing bar of FIGS. 3A-3D.

FIG. 3D shows a cross-sectional view of the flat-spring multi-sectional ionizing bar of FIGS. 3A-3C, with the section taken along line 3D-3D of FIG. 3E. As best shown therein enclosure housing 21 may support the ionization cell modules 16 from one side, and may house the high voltage power supply 12 with control system 14 within an interior side (covered by the enclosure 21). Also as shown therein an aperture 46 extending through an end wall of bar 10 permits daisy-chaining of multiple bars 10 together if desired. An ionization cell may include supporting structure(s) like posts 33 for ion emitter electrode 20 configured as a stretched wire. The posts 33 may be fixed on base plate 25 of the ionization cell 16 (see details in FIG. 3G).

A wire electrode tensioning system may include at least one coil-spring 20*b* (FIG. 4A-4C) or at least one flat-spring 20*a* (FIG. 3A-3H) (both types of springs are also clearly shown in FIG. 1A). The linear ionizer 20 is preferably tensioned to a range of about 150 gram-force ($g_f$) to about 300 gram-force ($g_f$), with about 250 gram-force ($g_f$) being most preferred. Wire emitter(s) 20 may have a diameter in the range of 30 microns to 200 microns, preferably 80-130 micron. Wire material may be any highly corrosive-resistant metal like specialized compositions of stainless steel, molybdenum, titanium, tungsten or alloys like "HASTELLOY", "ULTIMET" and others (such as nickel-titanium alloys) known in the art. Wire emitter(s) 20 may also have corrosive protected plating based on nickel, chromium, glass or titanium dioxide. Chemically cleaned and polished tungsten wire is one particularly preferred emitter material.

As shown in the various Figures, wire emitter(s) 20 may be centrally positioned along base plate 25, 25'" about 5 millimeters to 15 millimeters above the surface thereof (elevated from the surface) and preferably laterally offset (1 millimeter to 10 millimeters) from the orifice line(s) as discussed above.

The reference electrodes 32*a* and 32*b* may be configured as at least one conductive strip (or strips) positioned on the surface of the housing 21 generally parallel to the ion emitter electrode 20. Reference electrodes 32*a* and 32*b* are preferably held at ground potential (zero volts). Manifold 24 may be formed of electrically-neutral and/or isolative extruded plastic and/or other material and techniques known in the art.

According to test results this design of ionization cell substantially eliminates direct influence of air (gas) flow on wire emitter(s) 20, thereby preventing wire vibration and contamination. Positioning the air streams with preset horizontal offsets to the surface of wire electrode and tangential to the peripheral region of ion cloud(s) 22 also maximizes ions harvesting from corona discharge between the emitter and reference electrodes. Under this condition, the air streams and electrical field from emitter together move ions from the bar to the charged object TO.

Figure 3F:
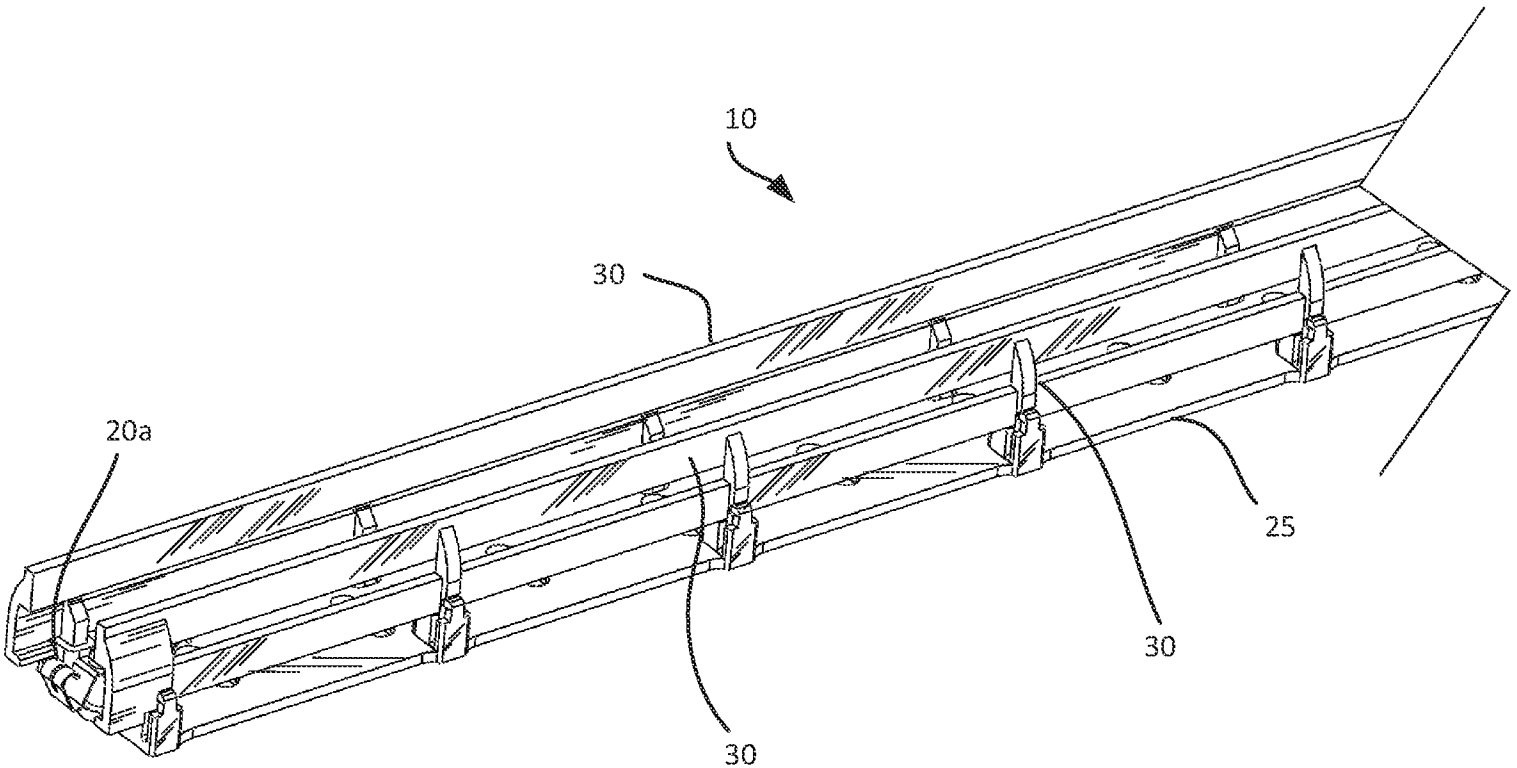
FIG. 3F is a perspective view of one of the detachable emitter-modules/ionization-cells as used in the preferred flat-spring ionizing bar of FIGS. 3A-3D.
Figure 3G:
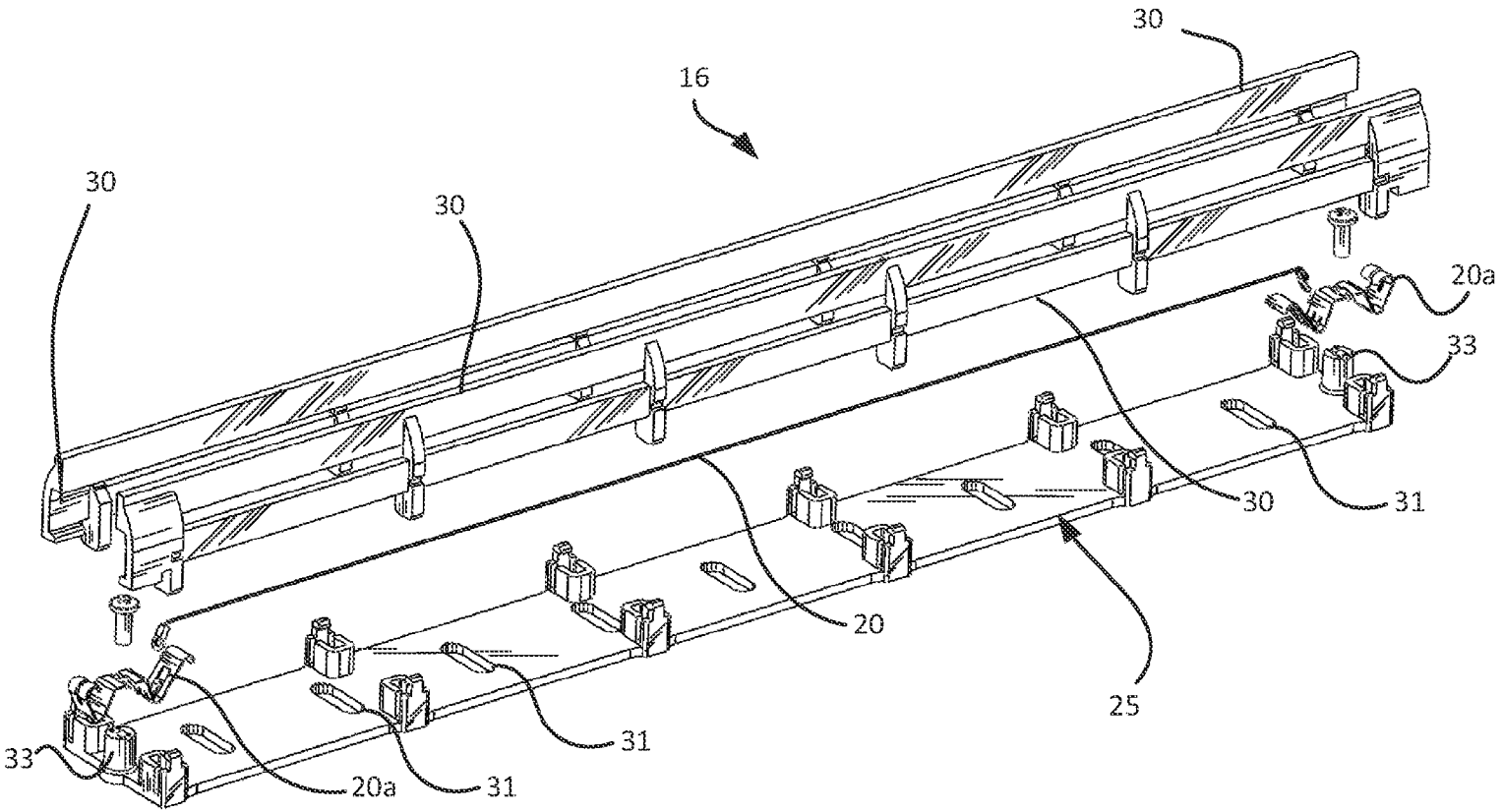
FIG. 3G is an exploded perspective view of the detachable emitter-module/ionization-cell of FIG. 3F.
Figure 4A:
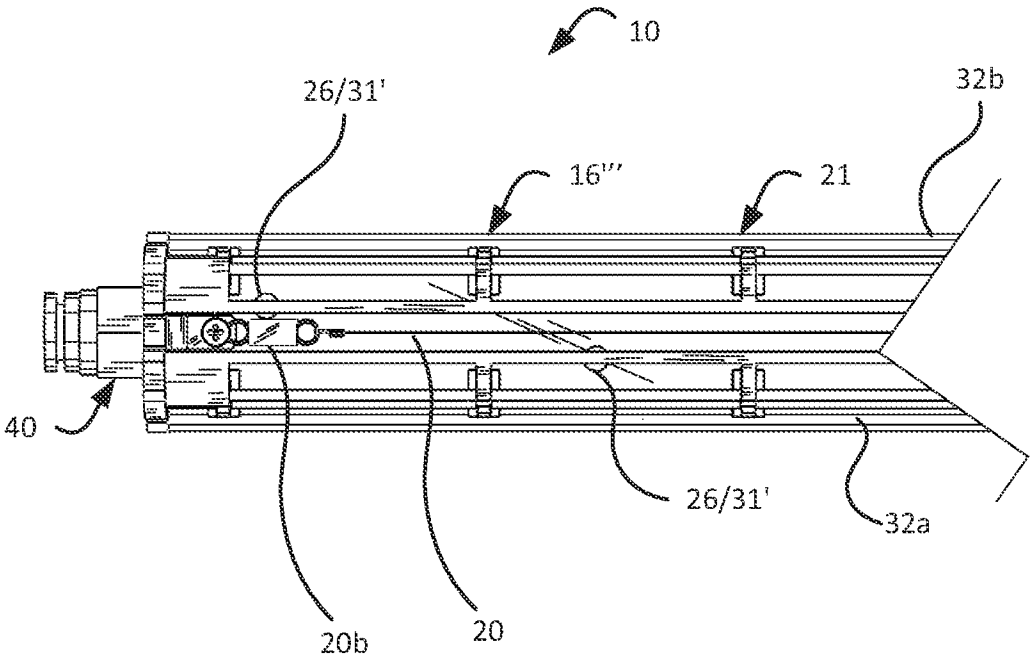
FIG. 4A is a bottom view of a preferred physical embodiment of a coil-spring multi-sectional ionizing bar of the present invention.
Figure 4B:
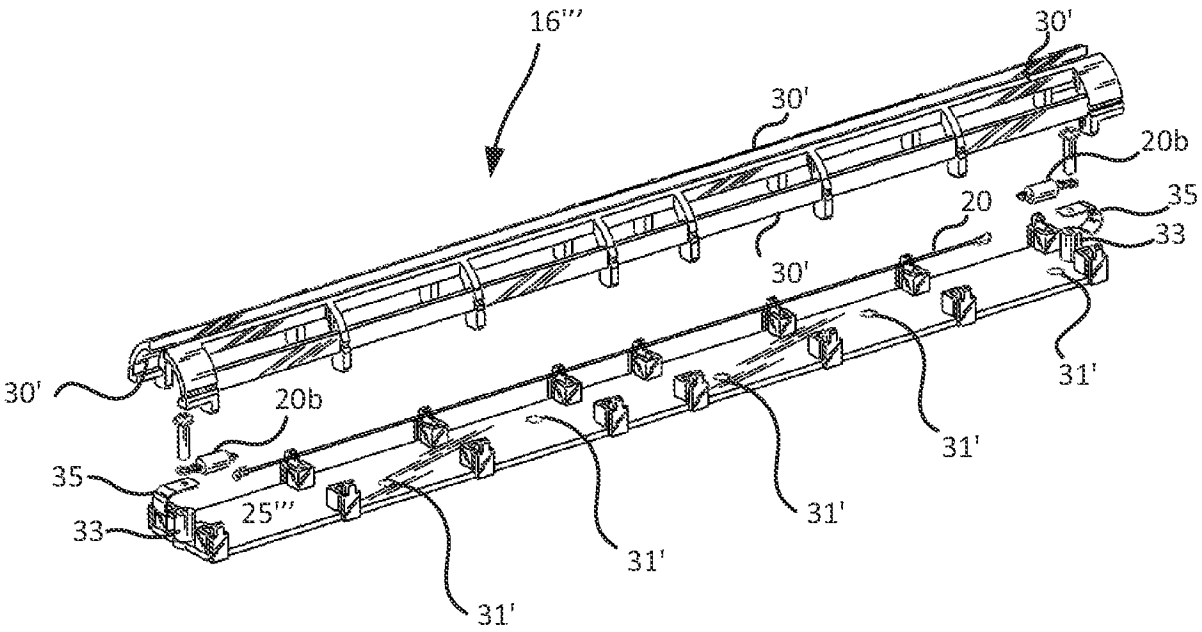
FIG. 4B is an exploded perspective view of the detachable emitter-module/ionization-cell used in the preferred ionizing bar of FIG. 4A.
Figure 4C:
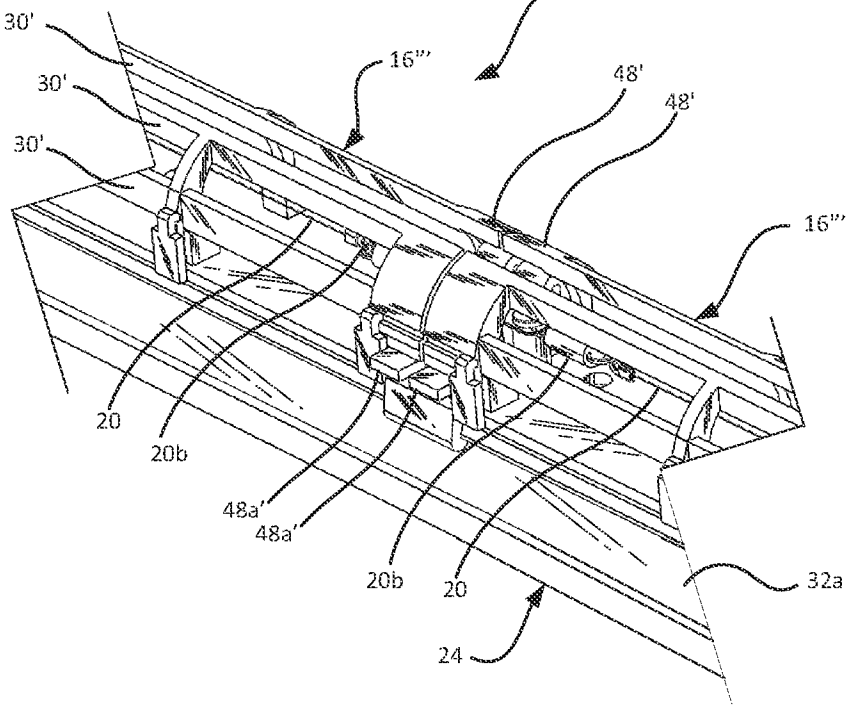
FIG. 4C illustrates in greater detail the junction between two detachable emitter modules of the coil-spring multi-sectional ionizing bar of FIGS. 4A and 4B.

Another important feature of the ionization cell is a wire-protection grill/lateral member of each detachable ion emitter section (see FIGS. 3G, 4B and 1A). The grill may comprise a set of louvers/rails mounted on common plate 25. Base plate 25 may have multiple openings 31, 31' (see especially FIGS. 3G and 4B) wherein each opening is aligned with the position of orifices 26, 26'" in the orifice (manifold) plate. The ribs may support a group (maybe several) of vented louvers/rails 30, 30' in spaced relation to one another. In use, the grills (lateral members) are in consistent contact with ionized gas flow and have significant effect on ion output and balance. Therefore, they are preferably formed of electrically-neutral material (defined as having a low affinity to acquire only one of positive or negative electrostatic charge(s)) and highly isolative. Such materials include ABS, polycarbonate, and other similar materials known in the art and, possibly any desired combination thereof.

The disclosed grill design may provide several interactive functions: It (1) serves as a physical guard for protection and support of the ionizing wire emitter; (2) provides easy access of ambient air to the high speed air jets for increasing effects of ambient air entrainment and amplification; (3) directs (collimates) ion flow from ionizing bar 10 toward the charged target object TO (for, example, FPD panels); and (4) serves as a guide/support for moving a brush, swap, foam block, duster or other cleaning tool/item along the length of the ionizing bar to thereby by clean one or more ionizing elements.

Another distinguishing feature of this invention is the detachable modules of the ionization bar (see assembled drawing of the ionization cell at FIG. 3F). One to ten (or even more) modules can be installed onto manifold 24 to form an ionization bar depending upon required length of the bar. The length of each module/cell may be in the range of about 50 millimeters to about 1500 millimeters (with 100 millimeters to 300 millimeters being most preferred).

As discussed and shown, the preferred physical embodiment of FIGS. 3A through 3H employs detachable wire ionization cells 16 with flat tension/contact springs 20*a* that are generally W-shaped in side elevation view. One significant advantage of this design is low electrical capacitance of the emitter electrode compared with designs employing coil-spring(s). In particular, the capacitance of a representative six-module ionizing bar (about 1.5 meters long) with flat-spring ionization cells is about 14 picoFarads. By contrast, it is noted that this is about 10% to about 30% less than the capacitance of a comparable ionizing bar using coil-springs. The result is minimal capacitive load on the HVPS 12, which, in turn, makes it possible to use compact, an inexpensive high frequency or pulse high voltage power supply. Finally, it will be appreciated that the contact springs are preferably positioned at a lower level (closer to base plate 25 of the module 16) relative to wire electrode 20 and they may be covered by a protective plastic screen (not shown). This makes it easy to move a cleaning brush along the bar. As noted above, the grills (lateral members) provide a physically unobstructed path along which some cleaning means/tool may be guided. Since the wire emitter is preferably elevated above the tensioning spring this arrangement permits simple and effective removal of corrosion, debris, dust, etc. that may accumulate on the wire without substantial interference by the spring(s).

Figure 3H:
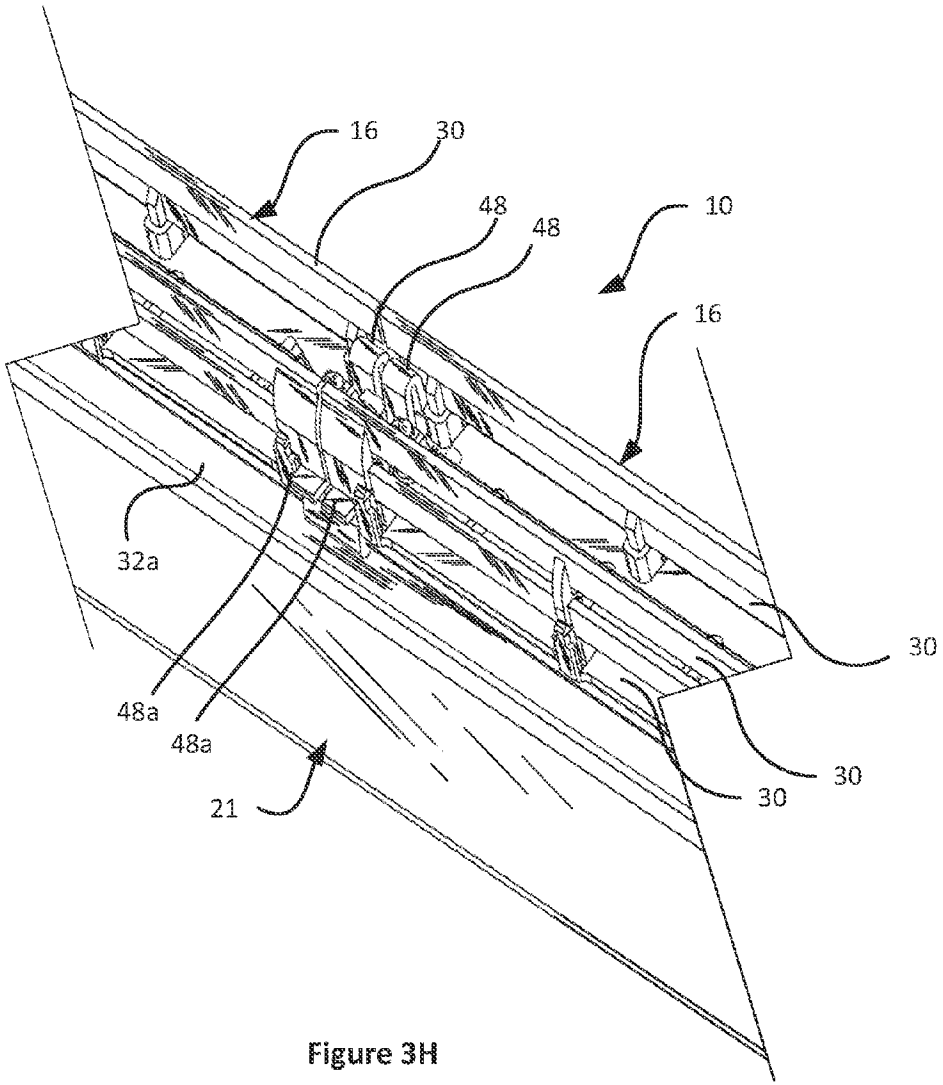
FIG. 3H illustrates in greater detail the junction between two detachable emitter modules of the flat-spring multi-sectional ionizing bar of FIGS. 3A-3G.

Another distinguishing feature of the disclosed inventive multi-sectional bar includes a set of cantilever type clips 48 provided for holding detachable ionization cells 16, 16''' in place. In particular, a pair of clips 48 locks each ionization cell 16, 16''' in a fixed preset position, relative to orifices 26 and the enclosure housing 21 (see, for example FIGS. 3H and 4C). Detachable clips 48 may be positioned along the orifice plate of manifold 24. Each set of clips helps ensure reliable electrical and mechanical contacts that lock the modules in a preset position relative to orifices in the manifold (see, for example, FIG. 4C, 3H). In use clips 48 are preferably detachably installed along the orifice plate of manifold 24. The ionization modules can be easily inserted into the clips to thereby electro-mechanically lock them in place relative to manifold 24 and adjacent ionization cells. To release an ionization cell one end at a time, the pair of opposite flexing cantilever arms 48*a* may be squeezed toward the middle plane. The distance between two flexing clips in traverse direction is wide enough to provide clearance for a cleaning brush, as shown in FIG. 3H. So, the cleaning brush, or other cleaning means, can be moved in both directions along the whole ionizing bar 10, removing contamination debris from all sections of emitter (wire).

The disclosed inventive multi-sectional ionizing bar offers an inexpensive modular design of ionization cells (or emitter sections) ready for easy assembly in mass production. They also provide efficient static neutralization with minimum air/gas and power consumption and are expected to greatly reduce maintenance expenses (labor for cleaning) in operation.

It will be appreciated by those of ordinary skill that inventive ionization cells 16, 16''' may each have one tension spring disposed at one end of emitter 20 to provide the desired tension rather than two. In such embodiments, the opposite end of emitter 20 may be fixedly attached (for example, with a screw received within end posts 33 of the type seen in FIGS. 3G and 4B) and some means for making external contact with adjacent ionizing bars may also be affixed thereto.

It will be appreciated by those of ordinary skill that ionizers in accordance with the invention are expected to last far longer (two to three years) than conventional pin-type emitter corona discharge ionizers. This is due to the aforementioned isolation of the wire-emitter 20 reducing corrosion. It has also been determined that with ionization cells of the present invention substantially zero corona discharge occurs in the vicinity of flat-springs 20*a* and that this reduces deterioration of the plastic components of the cells in that area (again, lengthening the life of each cell). Nonetheless, ionization cells will eventually degrade to the point where removal/disposal and replacement will be desirable and it may occur using clips 48 as discussed herein.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

What is claimed is:

1. A linear ionizing bar comprising:

at least one axis-defining linear ion emitter for establishing an ion cloud along the length thereof in response to the application of an ionizing voltage thereto, the ion cloud having a plasma region with an outer peripheral boundary;

means for receiving an ionizing voltage and for delivering the ionizing voltage to the linear ion emitter to thereby establish the ion cloud;

a reference electrode for presenting an electric field within the ion cloud in response to receipt of a non-ionizing voltage being applied to the reference electrode, the electric field inducing ions to leave the plasma region; and a manifold for receiving gas from a source and for delivering the gas past the linear ion emitter such that at least some of the gas flows tangent to the outer peripheral boundary of the plasma region but substantially none of the gas flows into the plasma region.

2. The linear ionizing bar of claim 1 wherein the means for receiving comprises spring tensioning contacts.

3. The linear ionizing bar of claim 1 wherein the linear ion emitter comprises at least one corona discharge wire having a diameter in the range of 30 microns to 200 microns and wherein the manifold further comprises plural channels with gas orifices for delivering the gas past the linear ion emitter.

4. The linear ionizing bar of claim 3 wherein the means for receiving comprises at least one spring tensioning contact in physical and electrical contact with the corona discharge wire to thereby tension the wire between about 150 gram-force and about 300 gram-force.

5. The linear ionizing bar of claim 3 wherein the spring comprises a flat-spring being at least generally W-shaped in side elevation and having a capacitance of less than about 2 picoFarads, and wherein the corona discharge wire is made of a corrosive-resistant metal selected from the group consisting of stainless steel, molybdenum, titanium, tungsten, "HASTELLOY" and "ULTIMET".

6. The linear ionizing bar of claim 1 wherein the manifold further comprises a plurality of staggered gas orifices on both sides of the linear ion emitter for delivering the gas from the manifold past the linear ion emitter such that at least some of the gas flows tangent to the outer peripheral boundary of the plasma region but substantially none of the gas flows into the plasma region.

7. The linear ionizing bar of claim 6 wherein the center of at least one orifice lies a horizontal distance X2 from the corona discharge wire; and the value of X2 is determined in accordance with the following equation:

$$X2=R+X1/\tan(90°-\beta), \text{ wherein}$$

R=the radius of the outer periphery of the plasma region:

X1 is the vertical distance between the wire emitter and the reference electrode and is a function of at least one of the voltage amplitude, the frequency and the ion current of the received ionizing voltage; and β=dispersion angle of the gas stream flowing from the at least one orifice.

8. The linear ionizing bar of claim 1 wherein the ionizing bar is located in an environment with ambient air, wherein the gas flow entrains the ambient air, wherein substantially no vibration is induced onto the linear emitter by the gas flow from the manifold and wherein substantially no contaminants from the gas flow and/or inherently present in the entrained ambient air contact the linear emitter.

9. The linear ionizing bar of claim 3 wherein the manifold further comprises a plurality of tube-like nozzles, each having a height at least generally perpendicular to the direction of the corona discharge wire, for delivering the gas past the linear ion emitter such that at least some of the gas flows tangent to the outer peripheral boundary of the plasma region but substantially none of the gas flows into the plasma region.

10. The linear ionizing bar of claim 9 wherein the center of at least one of the nozzles lies a horizontal distance X2 from the corona discharge wire; and the value of X2 is determined in accordance with the following equation:

$$X2=R+(X1-H)/\tan(90°-\beta), \text{ wherein}$$

R=the radius of the outer periphery of the plasma region:

X1 is the vertical distance between the wire emitter and the reference electrode and is a function of at least one of the voltage amplitude, the frequency and the ion current of the received ionizing voltage;

H is the height of the nozzle; and

β=dispersion angle of the gas stream flowing from the at least one orifice.

11. The linear ionizing bar of claim 9 wherein at least some of the nozzles are conductive and electrically connected to one another; and the reference electrode comprises the electrically connected conductive nozzles whereby corona discharge current flows from the corona discharge wire toward the conductive nozzles.

12. The linear ionizing bar of claim 2 wherein each spring tensioning contact is electrically connected to the ion emitter at one end thereof.

13. The linear ionizing bar of claim 1 wherein each ionization cell further comprises first and second lateral members disposed on laterally opposite sides of the axis-defining linear ion emitter and oriented at least generally parallel to the emitter axis, the lateral members having air-flow openings therethrough and being formed of formed of electrically-neutral and highly-isolative material.

14. A method of directing a neutralizing ionized stream of gas toward a charged target object using an ionizing bar of the type having an axis-defining linear ionizing emitter and a reference electrode and plural orifices for delivering a flow of gas toward the charged target object, the method comprising:

applying an ionizing voltage to the linear ion emitter to thereby establish an ion cloud along the length thereof, the ion cloud having an outer peripheral boundary;

applying a non-ionizing voltage to the reference electrode to thereby present a non-ionizing electric field within the ion cloud, the non-ionizing electric field inducing ions to leave the ion cloud; and delivering the gas through the orifices and past the linear ion emitter and toward the charged target object such that at least some of the gas flows tangent to the outer peripheral boundary of the ion cloud but substantially none of the gas flows into the ion cloud to thereby direct a neutralizing ionized stream of gas toward the charged target object.

15. The method of claim 14 wherein the step of delivering further comprises delivering the gas past the linear ion emitter and toward the charged target object such that at least some of the gas flows tangent to the outer peripheral boundary of the plasma region of the ion cloud but substantially none of the gas flows into the plasma region of the ion cloud to thereby direct a neutralizing ionized stream of gas toward the charged target object.

16. The method of claim 14 wherein the ionizing bar is located in an environment with ambient air, wherein the gas flow entrains the ambient air, wherein substantially no vibration is induced onto the linear emitter by the gas flowing past the linear ion emitter and wherein substantially no contaminants from the gas flow and/or from the entrained ambient air contact the linear emitter.

17. The method of claim 15 wherein the step of delivering further comprises delivering gas on both laterally opposite sides of the axis-defining linear ionizing emitter such that at least some of the gas flows tangent to the outer peripheral boundary of the plasma region but substantially none of the gas flows into the plasma region.

18. The method of claim 15 wherein the step of applying an ionizing voltage further comprises applying a voltage to the linear ionizing emitter to thereby establish a generally ellipsoidal plasma region along the length thereof.

19. The method of claim 14 further comprising simultaneously collimating the neutralizing ionized stream of gas from both lateral sides of the linear ion emitter as it flows toward the charged target object.

20. A selectively removable ionization cell for use in a multi-sectional linear ionizing bar comprising:

an elongated plate having a plurality of openings through which gas may flow, the openings being disposed in spaced relation to one another along the length of the elongated plate;

at least one axis-defining linear ion emitter for establishing an ion cloud along the length thereof in response to the application of an ionizing voltage, the ion cloud having an outer peripheral boundary and the emitter being suspended in spaced relation to the plate; and at least one spring tensioning contact for stretching the linear ion emitter, for receiving an ionizing voltage and for delivering the ionizing voltage to the linear ion emitter to thereby establish the ion cloud.

21. The ionization cell claim 20 wherein the linear ion emitter comprises at least one corona discharge wire having a diameter in the range of 30 microns to 200 microns.

22. The ionization cell of claim 21 wherein the spring tensioning contact is in physical and electrical contact with the corona discharge wire to thereby tension the wire between about 150 gram-force and about 300 gram-force.

23. The ionization cell of claim 20 wherein the spring comprises a flat-spring being at least generally W-shaped in side elevation and having a capacitance of less than about 2 picoFarads, and the corona discharge wire is made of a corrosive-resistant metal selected from the group consisting of stainless steel, molybdenum, titanium, tungsten, "HASTELLOY" and "ULTIMET".

24. The ionization cell of claim 20 wherein the ionization cell further comprises first and second lateral members disposed on laterally opposite sides of the axis-defining linear ionizing emitter and oriented at least generally parallel to the emitter axis, the lateral members being formed of formed of electrically-neutral and highly-isolative material.

25. The ionization cell of claim 24 wherein the linear ion emitter is suspended in greater spaced relation to the plate than the at least one spring tensioning contact and wherein the first and second lateral members provide a physically unobstructed path therebetween.

* * * * *